US006478454B1

(12) United States Patent
Jaffari et al.

(10) Patent No.: US 6,478,454 B1
(45) Date of Patent: Nov. 12, 2002

(54) ADJUSTABLE UPLIGHT LUMINAIRE WITH AN ADJUSTABLE REFLECTOR

(75) Inventors: Andy A. Jaffari, Belden, MS (US); Brad Waycaster, Tupelo, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/652,352

(22) Filed: Aug. 31, 2000

(51) Int. Cl.[7] ..... F21V 7/00

(52) U.S. Cl. ..... 362/307; 362/304; 362/306; 362/346

(58) Field of Search ..... 362/307, 297, 362/304, 306, 345, 346

(56) References Cited

U.S. PATENT DOCUMENTS 4,337,506 A * 6/1982 Terada ..... 362/142
4,943,901 A 7/1990 Baldwin et al.
5,251,116 A 10/1993 Wijbenga et al.
5,434,765 A * 7/1995 Kelly et al. ..... 362/274
5,582,479 A 12/1996 Thomas et al.
5,791,768 A 8/1998 Splane, Jr.
6,033,093 A * 3/2000 Latsis et al. ..... 362/304
6,126,300 A * 10/2000 Lee ..... 362/352
6,217,197 B1 * 4/2001 Siminovitch et al. ..... 362/297

* cited by examiner

*Primary Examiner*—Sandra O'Shea
*Assistant Examiner*—Ronald E. DelGizzi
(74) *Attorney, Agent, or Firm*—Jeffrey A. Haeberlin; Middleton Reutlinger

(57) ABSTRACT

A luminaire reflector for light sources is provided having a reflective metal housing to be positioned around a light source, the housing being provided with a translucent or transparent upper section through which light from the light source can exit in an upward direction while light from the reflective metal housing is directed primarily downwardly through an open bottom end of the housing, an internal reflector disk is positioned around the stem area of the light source above the major light emitting portion of the light source and is held in position by spring clips which permit the disk to be held at varied positions within the housing.

21 Claims, 3 Drawing Sheets

ADJUSTABLE UPLIGHT LUMINAIRE WITH AN ADJUSTABLE REFLECTOR

FIELD OF THE INVENTION

This invention relates to light source reflectors and in particular to reflectors having both upper and bottom light emitting areas.

BACKGROUND OF THE INVENTION

Reflectors or luminaires for lights, in particular reflectors for HID lights, often consist of substantially bell shaped housings, generally formed of metal, having an interior reflective surface and an open bottom which may be closed by a transparent lensor cover. The bulb normally is positioned vertically in the housing and has its stem projecting through a top opening which is usually dimensioned to provide a top opening no greater than the opening of a socket into which the end of the bulb stem is to be inserted or, in those instances where a portion of the bulb stem extends above the top of the reflector housing before insertion into the socket, the top opening is generally not much greater than the stem. In such housings, substantially all of the light emitted from the bulb is to be reflected downwardly through the open bottom of the housing. While it has been known to provide internal secondary reflector surfaces that can be adjusted axially of the bulb to effect focus of the light emitted from the bottom of the reflector housing, such as shown in U.S. Pat. Nos. 5,791,768 and 5,582,479, the principle purpose of those adjustable reflector sections is to direct a light to specific areas below the housing.

In certain instances it is desired to allow light to extend upwardly as well as downwardly from the housing and for this purpose it has been know to provide up-light openings through or adjacent the top of the housing. It has been proposed to provide auxiliary reflectors exterior of the housing to direct the up-light emanating from the top of the housing to desired areas such as, for example, as shown in U.S. Pat. No. 4,943,901. It has further been known to provide housings having peripheral light transmitting sections which allow up-light from the light source to pass through the periphery of an upper section of the housing to provide side lighting and to utilize secondary reflective surfaces to assist in directing the up-light through the peripheral light emitting sections, for example, as shown in U.S. Pat. No. 5,251,116.

Because such light reflecting housings, or luminaires, are positioned in diverse situations and at different heights, it would be advantageous to provide an up-light reflector which provides easy adjustability of the amount of light reflected downwardly in comparison to the amount of light emanating upwardly or outwardly.

SUMMARY OF THE INVENTION

This invention provides a reflective luminaire housing with an up-light transparent or translucent perimeter section adjacent a top of the housing surrounding the bulb generally upwardly of its main light emitting area. The interior of the luminaire housing below the up-light emitting section is provided with normally reflective internal surface characteristics. A secondary reflector is positioned interior of the housing generally in the area of the up-light emitting section and surrounding the stem of the bulb. The secondary reflector is positionable at various distances from the main light emitting section of the bulb whereby it can be positioned at varying heights within or above the up-light emitting section. The underside of the secondary reflector is finished with a reflective surface which primarily reflects up-light from the light emitting portion of the bulb downwardly through the open bottom end of the luminaire housing. By positioning the secondary reflector at different heights within the up-light emitting area of the housing, different quantities of up-light from the light emitting section of the bulb will be permitted to be transmitted through the transparent or translucent portion of the housing.

In an embodiment, the luminaire housing is a substantially bell shaped housing having an open bottom end with a top opening for receipt of the stem of a bulb to be positioned within the bell shaped housing and with a transparent or translucent section adjacent the top of the housing positioned above the light emitting section of the bulb. A disk shaped secondary reflector is carried within the housing inwardly of the transparent or translucent side walls and is variously positionable at different heights within the housing.

In an embodiment of the invention a reflective luminaire housing is provided having a housing section positioned between top and bottom ends providing an area through which light can pass and which is positioned above a normal light emitting section of a bulb contained within the housing. A moveable reflective surface is provided in the area which can be positioned at different heights within the area whereby the amount of light exiting the housing other than through the bottom of the housing can be adjusted by moving the moveable reflector, the reflector being secured to the housing by quick repositionable connectors.

In an embodiment an HID luminaire reflector is provided having a substantially bell shaped housing with an internal reflective surface surrounding and extending below the normal light emitting portion of an HID bulb received in the housing. Positioned above the reflecting surface is a light passing wall section and positioned interiorly of the housing within the light passing wall section is a moveable reflector moveable to different height levels within the light passing section, the light reflector formed as a disk having a central opening through which the bulb stem extends and the disk being carried by the housing through easily repositionable fastener devices which allow the disk to be securely held in a chosen one of a number of different height positions.

The features and objects of the invention will be apparent from the detailed description set forth hereinafter.

DETAILED DESCRIPTION OF THE PREFERRED EMBODIMENT

Figure 1:
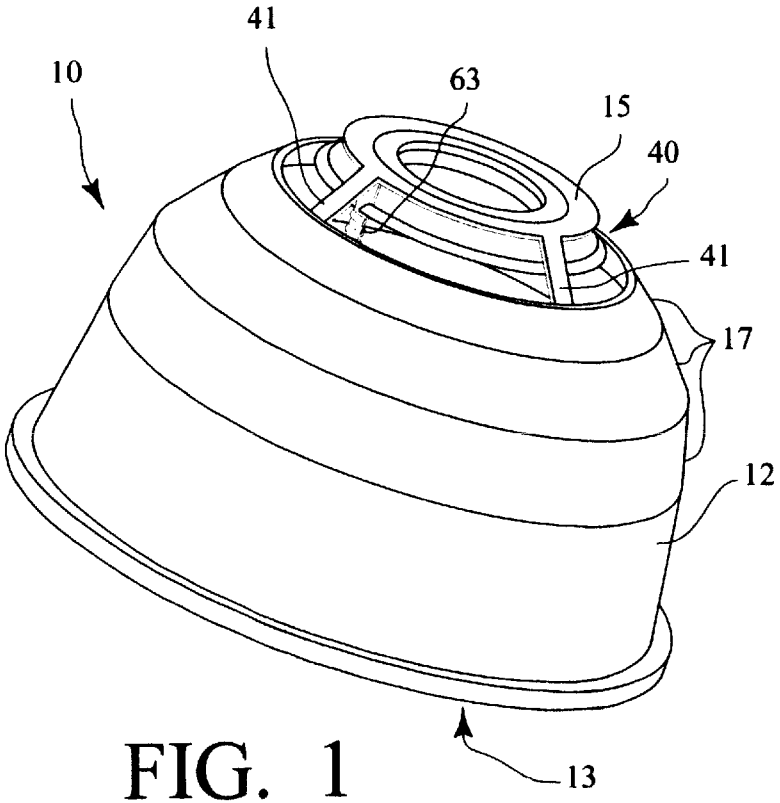
FIG. 1 is a perspective view of a luminaire housing with a up-light transparent wall section removed showing internal portions.
Figure 4:
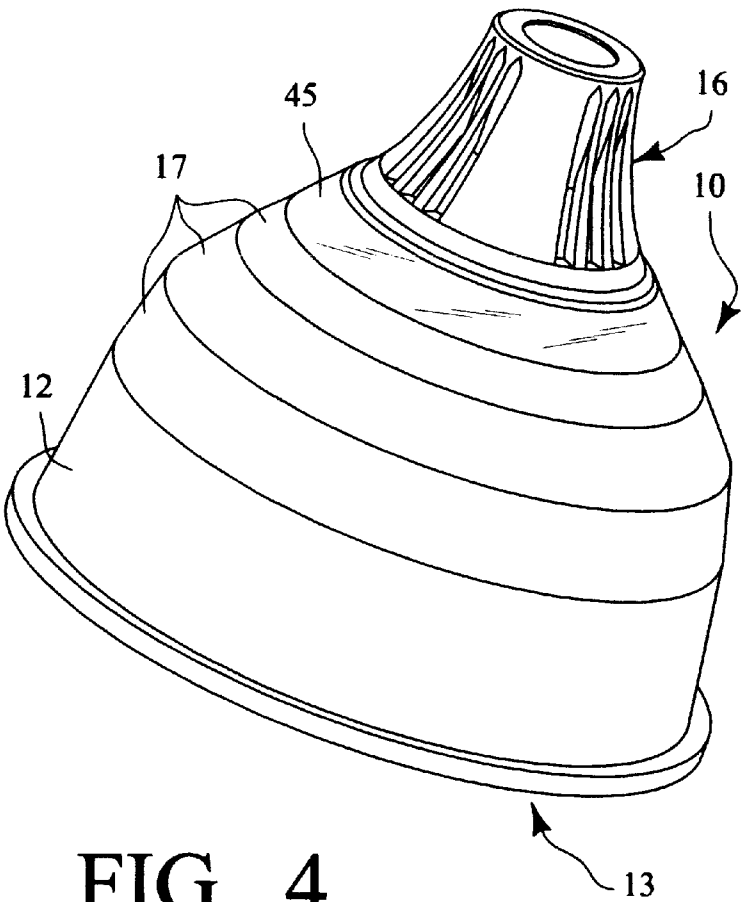
FIG. 4 illustrates the luminaire housing with an attachment collar affixed.
Figure 3:
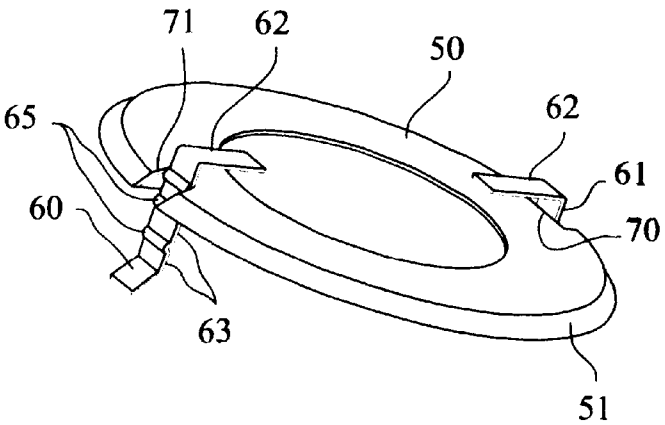
FIG. 3 is a view of a secondary repositionable reflector and spring clips for maintaining it in position.
Figure 6:
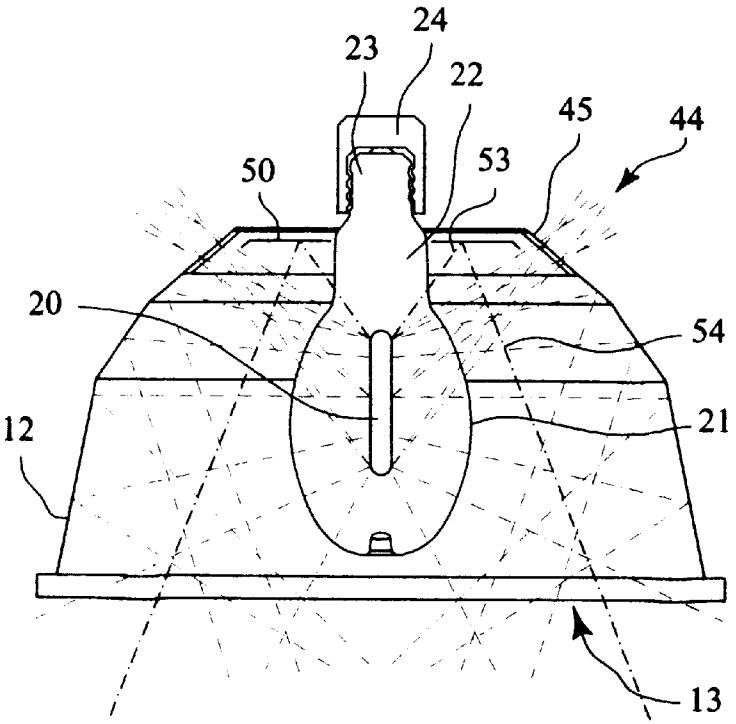
FIG. 6 is a schematic showing spectral reflection through a luminaire housing having the secondary reflector and up-light features of this invention.
Figure 5:
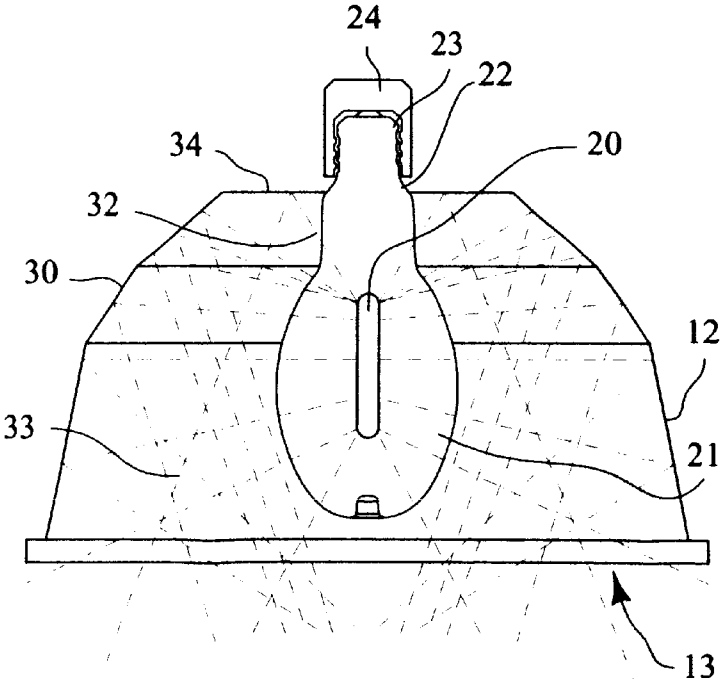
FIG. 5 PRIOR ART
FIG. 5 is a schematic showing spectral reflection within a normal luminaire housing.

FIG. 1 illustrates in perspective a luminaire housing 10. The housing is shown as a substantially bell shaped housing, however, it will understood that different shaped housings, including non-circular housings, may be provided. The housing includes a main reflector body 12 terminating in an open lower end 13 and a top attachment ring 15 to which a ballast or mounting collar 16 or the like can be affixed for attachment of the luminaire to a suspension base. As is well known to the art, the luminaire housing may include one or more frusto-conical sections 17 or other shapes differentiating from the pure bell shape. Moreover, those shapings may be formed on the interior surface and not, as illustrated on both interior and exterior surfaces. The interior surface is generally finished to enhance reflection and the various shapings, including frusto-conical sections may be chosen to provide for specific reflection patterns of the light emanating from the light generating portion 20 of a bulb 21. As illustrated in the schematics of FIGS. 5 and 6, the invention is useful in connection with high intensity discharge, compact flourescent, and similar lamps that utilize an arc member or arc tube for the light generating portion. As is normal, such bulbs 21 include a stem section 22 normally terminating in a threaded end 23 received into a socket 24 which may be formed as a part of a ballast assembly or may be a more standard lamp socket.

In normal closed housings 30, such as illustrated in FIG. 5, the light emanating from the arc tube 20 is reflected from all interior surfaces of the housing. In this manner up-light, as illustrated at 32, will be reflected downwardly as illustrated at 33 from the top 34 of the housing 30.

Figure 2:
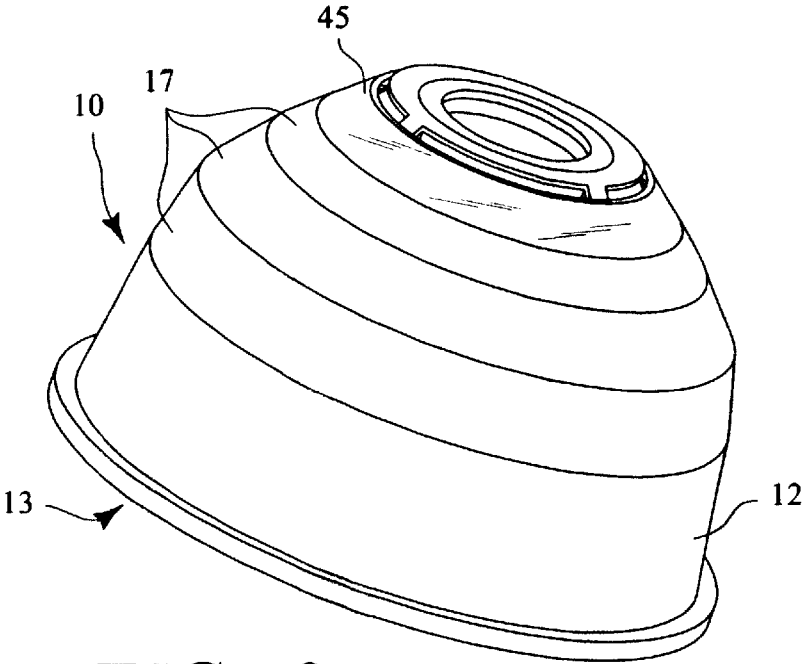
FIG. 2 is a view similar to FIG. 1 with the light transparent up-light section in place.

It is often times, however desirable, to allow escape of light in a upward or upward and outward direction so as to provide up-lighting to illuminate a ceiling or to illuminate stacks in a warehouse adjacent the luminaire or the like. To this end, the housing 12 may be provided with an open upper section 40 which in FIG. 1 is illustrated as lying between the top ring 15 and the upper most frusto-conical section 17. Struts or beams 41 may attach the ring 15 to the main body and be circumferentially spaced to provide equal support such that the opening 40 is then segmented circumferentially by the supports 41. A transparent or translucent housing section 45, as shown in FIG. 2, can be provided to close the opening 40. As illustrated in FIG. 6 light 44 directed upwardly from the arc tube 20 can then pass through the transparent (or translucent) section 45 to provide for up-lighting as well as side lighting.

To control the amount of up-light verses down light, according to this invention, a secondary reflector 50 is received around the stem 22 of the bulb and is variously positionable axially of the open section 40. The reflector is illustrated as being a dish shaped ring, the undersurface of which would be treated to provide the desired reflectivity and the angled outer boundary 51 of which can be provided variously shaped as desired to enhance or control reflection. In this manner, light 53 emanating upwardly from the arc tube 20 and striking the secondary reflector 50 will be reflected downwardly as indicated at 54 to exit the open end 13. As will be appreciated by variously positioning the secondary reflector 50 at different axial heights within the opening 40 a greater or lesser percentage of the up-light emanating from the light generating arc tube will be permitted to pass through the transparent section 45.

In the preferred embodiment, the secondary reflector 50 is held between spring fingers 60 and 61 which have top portions 62 affixed to the ring 15 and depending leg portions 63 which extend downwardly into the open area 40. Spaced grooves 65 are formed by shaped cross section bent sections of the fingers and have dimensions chosen to receive and grip the inside edge faces 70 of peripheral cut outs 71 formed in the secondary reflector 50. Thus the secondary reflector can be axially positioned by moving it to be engaged by upper or lower positioned grooves 65.

This use of spring fingers makes repositioning of the reflector a very simple task requiring only that the fingers be spread outwardly away from one another to allow the secondary reflector to be repositioned into another groove set. Although I have shown two spring fingers as being used diametrically opposite one another, it will of course be understood that a greater number of fingers may be used and that for secondary reflectors having shapes other than dish shaped, the fingers may be aligned to properly grip appropriate portions of the secondary reflector to maintain it in position.

Although I have illustrated the use of opposed spring fingers, it will be understood that other methods of attaching the secondary reflector to the housing top may be employed such as adjustable bolts or the like. These and other alternatives are considered equivalents and within the scope of the present invention.

What is claimed is:

1. A luminaire comprising a housing body having a hollow interior portion, the body having a primary light passage opening to the hollow interior portion, a light emitting source suspended in said hollow interior above the primary light passage opening, the body having a secondary light passage opening located above the light source opposite the primary light passage opening, the body having a primary reflective surface in the interior portion circumscribing said light emitting source, and a secondary reflector disposed above said light emitting source, the secondary reflector repositionably attached to the body and moveable between positions at various distances from the primary opening within an area of the housing adjacent the secondary light passage opening such that light from the light emitting source may be variably intercepted from passing through the secondary light passage opening.

2. The luminaire according to claim 1, wherein the light source is a bulb and the secondary reflector surrounds a stem of the bulb.

3. The luminaire according to claim 1, wherein the housing is substantially bell shaped, the primary light passage is at the bottom of the bell, the secondary light passage is adjacent an upper end of the bell and the secondary reflector is held in spring clips depending from an upper section of the bell.

4. A luminaire comprising an internally reflective metal housing positioned around a light source, the housing having a transparent upper section through which light from the light source can exit in an upward direction, the housing having a bottom light opening and a reflecting lower section directing light through the light opening, an internal reflector positioned above a light emitting section of the light source for reflecting light away from the internal reflector, the internal reflector being disposed above the reflecting lower section, the internal reflector moveably repositionable toward and away from the light source at least within the transparent upper section such that the amount of light exiting the transparent upper section may be varied, wherein the internal reflector is disc shaped with a stem of the light source extending through a center opening in the internal reflector.

5. The luminaire according to claim 4, wherein spring clips depend from an upper portion of the housing and engage the internal reflector to maintain it in position.

6. The luminaire according to claim 4, wherein the spring clips have a plurality of fixture points at different heights within the housing and wherein the internal reflector can be affixed to the spring clips at the different fixture points.

7. A luminaire comprising:

a main reflector body having an upper end, a lower end, and a side wall extending therebetween, said upper end defining an up-light opening, said lower end defining a down-light opening;

an attachment ring located above said main reflector body and in spaced relation to said main reflector body upper end;

a light source positioned within said main reflector body, said light source having a light generating region;

at least one spring clip attached to said attachment ring, said spring clip having a depending leg section, said depending leg section having spaced grooves formed therein; and a secondary reflector movably positioned between said light generating region and said attachment ring, said secondary reflector biasingly engaged by one of said spring clip leg section spaced grooves such that light emanating from said light generating region of said light source may be variably intercepted by said secondary reflector from passing through said space between said main reflector body upper end and said attachment ring.

8. The luminaire of claim 7 further comprising at least one strut between said attachment ring and said main reflector body upper end.

9. The luminaire of claim 8 further comprising a transparent housing section between said main reflector body upper end and said attachment ring, said transparent housing section enclosing said space between said main reflector body upper end and said attachment ring.

10. The luminaire of claim 7 wherein said secondary reflector further has at least one peripheral cut out which is engagable with said spaced grooves of said spring clip leg.

11. The luminaire of claim 7 wherein said light source is a lamp having a stem section, wherein said attachment ring has a lamp stem section receiving opening, wherein said secondary reflector has a lamp stem section receiving opening, and wherein said lamp is oriented such that said stem section is received by said attachment ring lamp stem section receiving opening and by said secondary reflector lamp stem section receiving opening.

12. A luminaire comprising:

a light source having a light generation region;

a main reflector body circumscribing said light source, said main reflector body having an upper end, a lower end, and a side wall extending therebetween, said upper end defining an up-light opening; said lower end defining a down-light opening, said side wall having a reflective inner surface;

an attachment ring located above said main reflector body and in spaced relation to said main reflector body upper end;

at least one spring clip depending from said attachment ring; and a secondary reflector positioned between said light generation region and said attachment ring, said secondary reflector retained by said at least one spring clip.

13. The luminaire of claim 12 further comprising a light transmissive housing section enclosing said space between said attachment ring and said main reflector body upper end.

14. The luminaire of claim 13 wherein said light transmissive housing section has a plurality of struts, said struts connected between said attachment ring and said main reflector body upper end, said plurality of struts being in spaced relation to each other such that light may, exit said light transmissive housing section between said plurality of struts.

15. The luminaire of claim 14 wherein said secondary reflector is disc shaped, said secondary reflector further having an undersurface and an angled outer periphery, said undersurface being treated to provide a predetermined reflectivity, and said angled outer periphery having a predetermined angular measurement.

16. The luminaire of claim 15 wherein said light source is a lamp having a stem section, wherein said attachment ring has a stem receiving opening, wherein said secondary reflector has a stem receiving opening, wherein said lamp stem section extends through said secondary reflector stem receiving opening and said attachment ring stem receiving opening.

17. The luminaire of claim 16 wherein said at least one spring clip further comprises a top portion and a depending leg portion, said top portion being attached to said attachment ring, said leg portion having spaced grooves formed therein, said spaced grooves cooperating with said secondary reflector to retain said secondary reflector.

18. A luminaire comprising:

a light source having a light generation region;

a main reflector body circumscribing said light source, said main reflector body having an upper end, a lower end, and a side wall extending therebetween, said upper end defining an up-light opening; said lower end defining a down-light opening, said side wall having a reflective inner surface;

an attachment ring located above said main reflector body and in spaced relation to said main reflector body upper end;

a secondary reflector positioned between said light generation region and said attachment ring; and means for vertically adjusting said secondary reflector position such that light emanating from said light generating region will be variably intercepted by said secondary reflector from passing through said space between said attachment ring and said main reflector body upper end.

19. The luminaire of claim 18 further comprising a light transmissive housing section enclosing said space between said attachment ring and said main reflector body upper end.

20. The luminaire of claim 19 wherein said secondary reflector further has an undersurface, said undersurface having a predetermined reflectivity.

21. The luminaire of claim 20 wherein said secondary reflector further has an angled outer periphery, said angular outer periphery having predetermined angular measurement.

* * * * *